US007821508B2

(12) United States Patent
Park et al.

(10) Patent No.: US 7,821,508 B2
(45) Date of Patent: Oct. 26, 2010

(54) DISPLAY DEVICE AND DRIVING DEVICE AND DRIVING METHOD THEREOF

(75) Inventors: Keun-Woo Park, Gangnam-gu (KR); Pil-Mo Choi, Seoul (KR); Kook-Chul Moon, Yongin-si (KR); Ung-Sik Kim, Suwon-si (KR); Seock-Cheon Song, Suwon-si (KR); Ho-Suk Maeng, Seoul (KR); Sang-Hoon Lee, Seoul (KR)

(73) Assignee: Samsung Electronic Co., Ltd., Suwon-Si (KR)

( * ) Notice: Subject to any disclaimer, the term of this patent is extended or adjusted under 35 U.S.C. 154(b) by 1084 days.

(21) Appl. No.: 11/489,290

(22) Filed: Jul. 19, 2006

(65) Prior Publication Data

US 2007/0033016 A1 Feb. 8, 2007

(30) Foreign Application Priority Data

Jul. 25, 2005 (KR) ..... 10-2005-0067258

(51) Int. Cl.
*G09G 3/36* (2006.01)

(52) U.S. Cl. ..... 345/204; 345/87; 345/98; 345/99

(58) Field of Classification Search ..... 345/87, 345/98, 99, 199, 204, 208, 217, 210, 100; 375/354, 355

See application file for complete search history.

(56) References Cited

U.S. PATENT DOCUMENTS 4,710,727 A * 12/1987 Rutt ..... 330/110
5,073,727 A 12/1991 Shizu ..... 326/121
5,189,318 A * 2/1993 Tanaka ..... 327/91
5,491,429 A 2/1996 Gasparik ..... 326/27
2002/0145480 A1* 10/2002 Saito ..... 331/100
2002/0168024 A1* 11/2002 Hedberg ..... 375/296
2003/0048246 A1* 3/2003 Ham ..... 345/87
2003/0121401 A1* 7/2003 Ito ..... 84/625
2005/0078101 A1* 4/2005 Shigeta ..... 345/204
2005/0174344 A1* 8/2005 La ..... 345/208
2005/0226355 A1* 10/2005 Kibune et al. ..... 375/348
2005/0264511 A1* 12/2005 Takaki ..... 345/98

FOREIGN PATENT DOCUMENTS

CN 1471257 A 1/2004
JP 50-020628 3/1975

(Continued)

OTHER PUBLICATIONS

Kamemua, Akihiro; Radio Repeater and Radio Relay System; Dec. 12, 1997; Pub. No. JP409321688A.*

*Primary Examiner*—Bipin Shalwala
*Assistant Examiner*—Vince E Kovalick
(74) *Attorney, Agent, or Firm*—F. Chau & Associates, LLC

(57) ABSTRACT

A driving apparatus for a display device includes a signal controller synthesizing first and second signals, respectively, having first and second signal levels to output a synthesized signal having third to fifth signal levels, a signal extracting unit extracting the first and second control signals from the synthesized signal, a gate driver generating gate signals based on the first control signal, and a data driver generating data signals based on the second control signal.

15 Claims, 7 Drawing Sheets

FOREIGN PATENT DOCUMENTS

| | | |
|---|---|---|
| JP | 54-052406 | 4/1979 |
| JP | 61-237515 | 10/1986 |
| JP | 04-359679 | 12/1992 |
| JP | 2000-031946 | 1/2000 |
| KR | 1992-0010045 | 6/1992 |
| KR | 100216408 | 5/1999 |
| KR | 100396831 | 8/2003 |
| KR | 1020040110553 | 12/2004 |

* cited by examiner

DISPLAY DEVICE AND DRIVING DEVICE AND DRIVING METHOD THEREOF

CROSS-REFERENCE TO RELATED APPLICATION

The present application claims priority from Korean Patent Application No. 2005-0067258, filed on Jul. 25, 2005, the disclosure of which is hereby incorporated herein by reference in its entirety.

BACKGROUND OF THE INVENTION (a) Technical Field

The present disclosure relates to a display device and a driving device, and a driving method thereof.

(b) Discussion of Related Art

A liquid crystal display (LCD) includes a pair of panels provided with field generating electrodes and a liquid crystal (LC) layer having dielectric anisotropy that is disposed between the two panels. The field generating electrodes generally include a plurality of pixel electrodes arranged in a matrix and connected to switching elements such as thin film transistors (TFTs) to be supplied with data voltages every row and a common electrode covering a surface of a panel and supplied with a common voltage. A pair of field generating electrodes that generate the electric field in cooperation with each other and an LC layer disposed therebetween form a so-called LC capacitor that is a basic element of a pixel along with a switching element.

The LCD applies the data voltages to the field generating electrodes to generate an electric field to the LC layer, and the strength of the electric field can be controlled by adjusting the data voltages across the LC capacitor. Since the electric field determines the orientations of LC molecules and the LC molecular orientations determine the transmittance of light passing through the LC layer, so that the LCD displays a desired image. In order to prevent image deterioration due to long-time application of a unidirectional electric field, polarity of the data voltages with respect to the common voltage is reversed every frame, every row, or every pixel.

A driving apparatus for the LCD is formed with at least one integrated circuit (IC) chip which is mounted on the LCD or integrated with an LC panel assembly. However, as the number of output terminals of the IC chip increases, the price as well as the size of the IC chip increases. Therefore, the IC chip is desirable to decrease the number of the output terminals of the IC chip.

SUMMARY OF THE INVENTION

Embodiments of the present invention provide a driving apparatus capable of decreasing the number of the output terminals and a Liquid crystal display (LCD) including the above-mentioned driving apparatus.

In an embodiment of the preset invention, there is provided a driving apparatus for a display device including a signal controller synthesizing first and second signals, respectively, having first and second signal levels to output a synthesized signal having third to fifth signal levels, a signal extracting unit extracting the first and second control signals from the synthesized signal, a gate driver generating gate signals based on the first control signal, and a data driver generating data signals based on the second control signal.

The synthesized signal may be generated on the basis of combinations of the signal levels of the first and second control signals.

The first and second control signals may have the same signal level as each other with respect to one signal level of the third to fifth signal levels.

The third to fifth signal levels may be a high level, a middle level, and a low level, respectively, and when the synthesized signal has the middle level, the first and second control signals may have signal levels that are equal to each other.

When the first and second control signals have the first signal level, the synthesized signal has the third signal level, when the first control signal has the first signal level and the second control signal has the second signal level, the synthesized signal has the fourth signal level, when the first control signal has the second signal level and the second control signal has the first signal level, the synthesized signal has the fifth signal level, and the first and fourth signal levels may be a low level, the second and fifth signal levels may be a high level, and the third signal level may be a middle level.

The first and second control signals may be each transferred to the gate and data drivers through different signal lines.

The signal extracting unit may include first and second signal extractors extracting the first and second control signals, respectively.

The first signal extractor may include at least one PMOS transistor and a plurality of NMOS transistors, and the number of the NMOS transistors may be greater than the number of the PMOS transistors.

The PMOS transistor and the NMOS transistors may have output and input terminals connected in series with each other, and have control terminals connected to each other, which are supplied with the synthesized signal.

The second signal extractor may include a plurality of PMOS transistors and at least one NMOS transistor, and wherein the number of the PMOS transistors may be greater than the number of the NMOS transistor.

The PMOS transistors and the NMOS transistor may have output and input terminals connected in series to each other, and have control terminals connected to each other and supplied with the synthesized signal.

One of the first and second signal extractors may include an inverter.

The first control signal may be a scanning start signal and the second control signal may be a horizontal synchronization start signal.

In an embodiment of the present invention, there is provided a driving apparatus including a signal controller synthesizing at least three signals having two signal levels to output a synthesized signal having at least four signal levels, and a signal extracting unit extracting the at least three signals from the synthesized signal.

The signal extracting unit may include a plurality of PMOS transistors and a plurality of NMOS transistors.

The driving apparatus may further include a data driver and a gate driver outputting data signals and gate signals based on the three signals from the signal extracting unit, respectively.

In an embodiment of the present invention, there is provided a display device including a signal controller synthesizing first and second signals, respectively, having first and second signal levels to output a synthesized signal having third to fifth signal levels, a signal extracting unit extracting the first and second control signals from the synthesized signal, a gate driver generating gate signals based on the first control signal, and a data driver generating data signals based on the second control signal.

The first control signal may be a scanning start signal and the second control signal may be a horizontal synchronization start signal.

In an embodiment of the present invention, there is provided a driving method for a display device including synthesizing first and second control signals having two signal levels to output a synthesized signal having three signal levels, extracting the first and second control signals from the synthesized signal, outputting gate signals based on the extracted first control signal, and outputting data signals based on the extracted second control signal.

BRIEF DESCRIPTION OF THE DRAWINGS

Exemplary embodiments of the present invention can be understood in more detail from the following descriptions taken in conjunction with the accompanying drawings, in which.

DETAILED DESCRIPTION OF EXEMPLARY EMBODIMENTS

Exemplary embodiments of the present invention will be described more fully hereinafter with reference to the accompanying drawings. This invention may, however, be embodied in many different forms and should not be construed as limited to the embodiments set forth herein.

A driving apparatus and an LCD thereof according to an embodiment of the present invention will now be described with reference to FIGS. 1 and 2.

Figure 1:
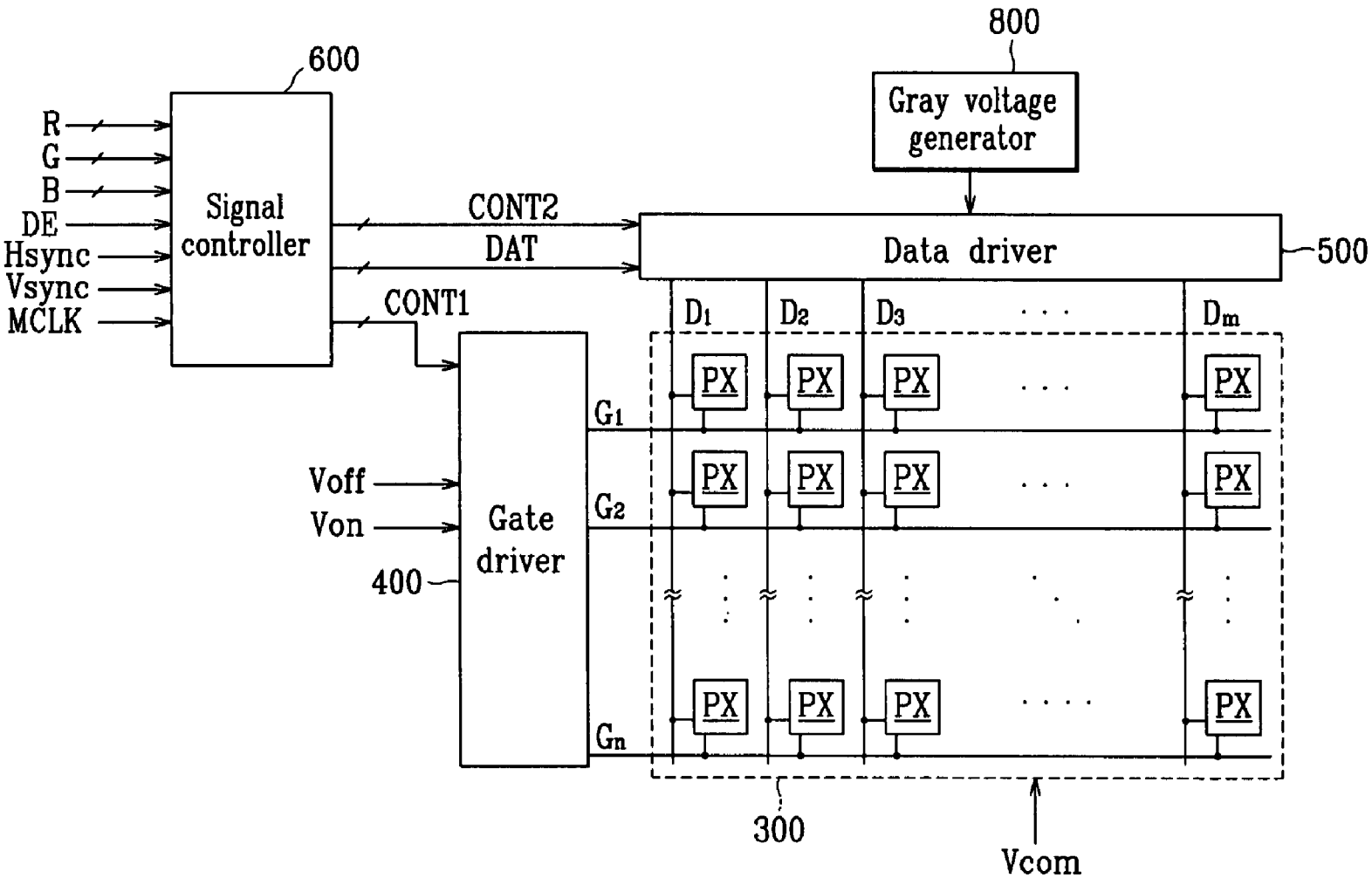
FIG. 1 is a block diagram of an LCD according to an embodiment of the present invention.
Figure 2:
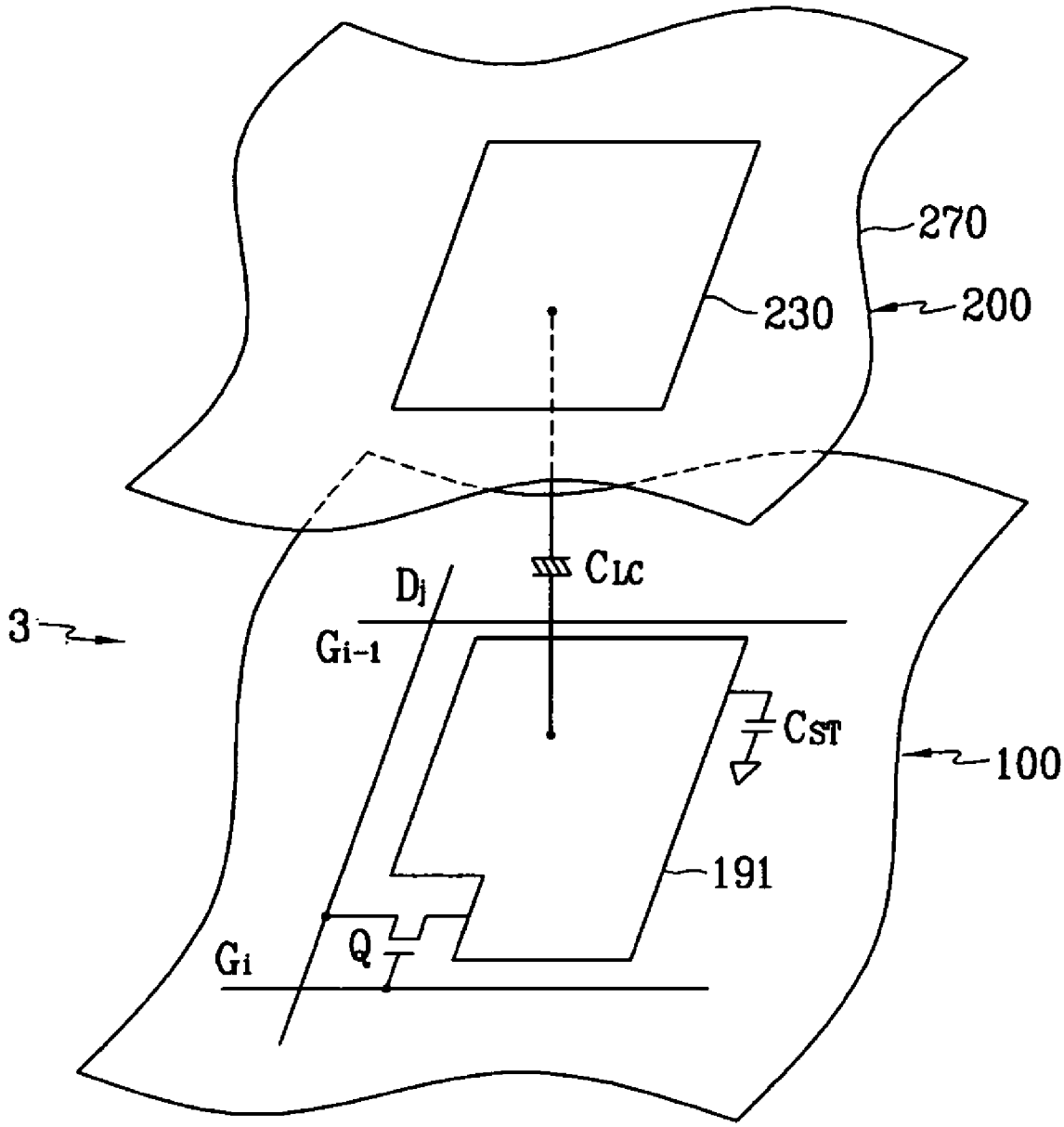
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment of the present invention includes an LC panel assembly 300 with a gate driver 400 and a data driver 500 connected thereto, a gray voltage generator 800 connected to the data driver 500, and a signal controller 600 controlling the above-described elements.

The LC panel assembly 300, in a structural view shown in FIG. 2, includes a lower panel 100, an upper panel 200, and an LC layer 3 disposed therebetween. The lower panel 100 includes a plurality of signal lines $G_1$ to $G_n$ and $D_1$ to $D_m$ and a plurality of pixels PX connected thereto and arranged substantially in a matrix, in a view shown in FIGS. 1 and 2.

The signal lines $G_1$ to $G_n$ and $D_1$ to $D_m$ are provided on the lower panel 100 and include a plurality of gate lines $G_1$ to $G_n$ transmitting gate signals (called scanning signals) and a plurality of data lines $D_1$ to $D_m$ transmitting data signals. The gate lines $G_1$ to $G_n$ extend substantially in a row direction and are substantially parallel to each other, while the data lines $D_1$ to $D_m$ extend substantially in a column direction and are substantially parallel to each other.

Each pixel PX, for example a pixel PX connected to a i_th gate line $G_i$ (i=1, 2, . . . , n) and a j_th data line $D_j$ (j=1, 2, . . . , m), includes a switching element Q that is connected to the display signal lines $G_1$-$G_n$ and $D_1$-$D_m$ and an LC capacitor $C_{LC}$, and a storage capacitor $C_{ST}$ that are connected to the switching element Q. The storage capacitor $C_{ST}$ may be omitted.

The switching element Q such as a TFT is provided on the lower panel 100 and has three terminals: a control terminal connected to one of the gate lines $G_1$ to $G_n$; an input terminal connected to one of the data lines $D_1$ to $D_m$; and an output terminal connected to the LC capacitor $C_{LC}$ and the storage capacitor $C_{ST}$.

The LC capacitor $C_{LC}$ includes a pixel electrode 191 provided on the lower panel 100 and a common electrode 270 provided on the upper panel 200 as two terminals. The LC layer 3 disposed between the two electrodes 191 and 270 functions as a dielectric of the LC capacitor $C_{LC}$. The pixel electrode 191 is connected to the switching element Q and the common electrode 270 is supplied with a common voltage Vcom and covers a surface of the upper panel 200. Unlike what is shown in FIG. 2, the common electrode 270 may be provided on the lower panel 100, and both electrodes 191 and 270 may have shapes of bars or stripes.

The storage capacitor $C_{ST}$ is an auxiliary capacitor for the LC capacitor $C_{LC}$. The storage capacitor $C_{ST}$ includes the pixel electrode 191 and a separate signal line (not shown), which is provided on the lower panel 100, overlaps the pixel electrode 191 via an insulator, and is supplied with a predetermined voltage such as the common voltage Vcom. Alternatively, the storage capacitor $C_{ST}$ includes the pixel electrode 191, and an adjacent gate line called a previous gate line, which overlaps the pixel electrode 191 via an insulator.

To display a color image, each pixel uniquely represents one of the primary colors, that is, spatial division, or each pixel sequentially represents the primary colors in turn (, that is, temporal division, such that a spatial or temporal sum of the primary colors is recognized as a desired color. An example of a set of the primary colors includes red, green, and blue colors. FIG. 2 shows an example of the spatial division in which each pixel includes a color filter 230 representing one of the primary colors in an area of the upper panel 200 facing the pixel electrode 191. Alternatively, the color filter 230 may be provided on or under the pixel electrode 191 on the lower panel 100.

One or more polarizers (not shown) are attached to at least one of the panels 100 and 200.

Referring to FIG. 1 again, the gray voltage generator 800 generates two sets of reference gray voltages related to the transmittance of the pixels. Each set of gray voltages includes the gray voltages having a positive polarity with respect to the common voltage Vcom and the gray voltages having a negative polarity with respect to the common voltage Vcom. However, the gray voltage generator 800 may generate only one set of reference gray voltages.

The gate driver 400 is connected to the gate lines $G_1$ to $G_n$ of the panel assembly 300 and synthesizes the gate-on voltage Von and the gate-off voltage Voff to generate gate signals for application to the gate lines $G_1$ to $G_n$.

The data driver 500 is connected to the data lines $D_1$ to $D_m$ of the panel assembly 300 and applies data voltages, which are selected from the gray voltages supplied from the gray voltage generator 800, to the data lines $D_1$ to $D_m$. However, the data driver 500 may generate gray voltages for all the grays by dividing the reference gray voltages, and select the data voltages from the generated gray voltages, when the gray voltage generator 800 generates reference gray voltages.

The signal controller 600 controls the gate driver 400 and the data driver 500. Each of the driving units 400 and 500 may include at least one integrated circuit (IC) chip placed on the LC panel assembly 300 or on a flexible printed circuit (FPC) film in a tape carrier package (TCP) type, which are attached to the panel assembly 300. Alternately, at least one of the processing units 400, 500, 600, and 800 may be integrated with the panel assembly 300 along with the signal lines $G_1$ to $G_n$ and $D_1$ to $D_m$ and the switching elements Q. As the further alternative, all the processing units 400, 500, 600, and 800 may be integrated into a single IC chip, but at least one of the processing units 400, 500, 600, and 800 or at least one circuit element in at least one of the processing units 400, 500, 600, and 800 may be disposed out of the single IC chip.

The signal controller 600 is supplied with input image signals R, G, and B and inputs control signals for controlling the display thereof from an external graphics controller (not shown). The input image signals R, G, and B contain luminance information of each pixel PX, and the luminance has a predetermined number of, for example 1024(=$2^{10}$), 256(=$2^8$), or 64(=$2^6$) grays. The input control signals include a vertical synchronization signal Vsync, a horizontal synchronization signal Hsync, a main clock signal MCLK, and a data enable signal DE.

After generating gate control signals CONT1 and data control signals CONT2 and processing the image signals R, G, and B to be suitable for the operation of the panel assembly 300 on the basis of the input control signals and the input image signals R, G, and B, the signal controller 600 outputs the gate control signals CONT1 to the gate driver 400, and the processed image signals DAT and the data control signals CONT2 to the data driver 500.

The gate control signals CONT1 include a scanning start signal STV for indicating the start of scanning, and at least one clock signal for controlling the output time of the gate-on voltage Von. The gate control signals CONT1 may further include an output enable signal OE for defining the duration of the gate-on voltage Von.

The data control signals CONT2 include a horizontal synchronization start signal STH for indicating the start of data transmission for a group of pixels PX, a load signal LOAD for instructing application of the data voltages to the data lines $D_1$ to $D_m$, and a data clock signal HCLK. The data control signal CONT2 may further include an inversion signal RVS for reversing the polarity of the data voltages with respect to the common voltage Vcom.

In response to the data control signals CONT2 from the signal controller 600, the data driver 500 receives a packet of the digital image data DAT for the group of pixels PX from the signal controller 600 and one of the two sets of the gray voltages supplied from the gray voltage generator 800. The data driver 500 converts the image data DAT into analog data voltages selected from the gray voltages supplied from the gray voltage generator 800 and applies the data voltages to the data lines $D_1$ to $D_m$.

The gate driver 400 applies the gate-on voltage Von to the gate lines $G_1$ to $G_n$ in response to the gate control signals CONT1 from the signal controller 600, thereby turning on the switching elements Q connected thereto. The data voltages applied to the data lines $D_1$ to $D_m$ are supplied to the pixels PX through the activated switching elements Q.

The difference between the data voltage and the common voltage Vcom is represented as a voltage across the LC capacitor $C_{LC}$, which is referred to as a pixel voltage. The LC molecules in the LC capacitor $C_{LC}$ have orientations depending on the magnitude of the pixel voltage, and the molecular orientations determine the polarization of light passing through the LC layer 3. The polarizer converts light polarization to light transmittance such that the pixels PX display the luminance represented by the image data DAT.

By repeating this procedure by a unit of a horizontal period which is denoted by "1H" and is equal to one period of the horizontal synchronization signal Hsync and the data enable signal DE, all gate lines $G_1$ to $G_n$ are sequentially supplied with the gate-on voltage Von during a frame, thereby applying the data voltages to all pixels PX.

When the next frame starts after one frame finishes, the inversion control signal RVS applied to the data driver 500 is controlled such that the polarity of the data voltages is reversed (which is referred to as "frame inversion"). The inversion control signal RVS may also be controlled such that the polarity of the data voltages flowing in a data line in one frame are reversed during one frame (for example, line inversion and dot inversion), or the polarity of the data voltages in one packet are reversed (for example, column inversion and dot inversion).

Next, when a driving apparatus for an LCD according to an embodiment of the present invention includes an IC chip, the driving apparatus reducing the number of the output terminals thereof will be described with reference to FIGS. 3 to 6.

Figure 3:
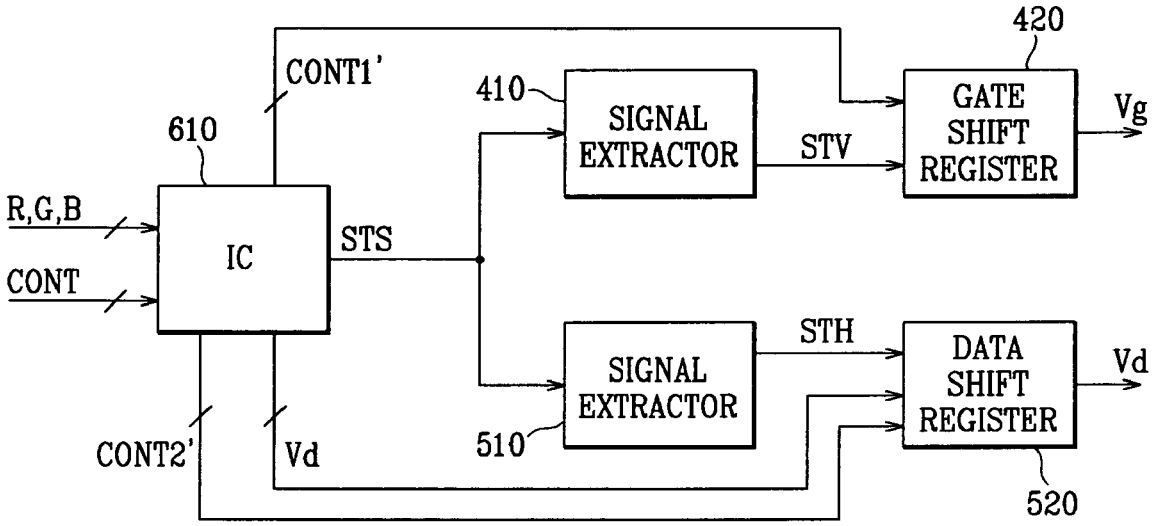
FIG. 3 is a block diagram of a driving apparatus for an LCD according to an embodiment of the present invention.
Figure 4:
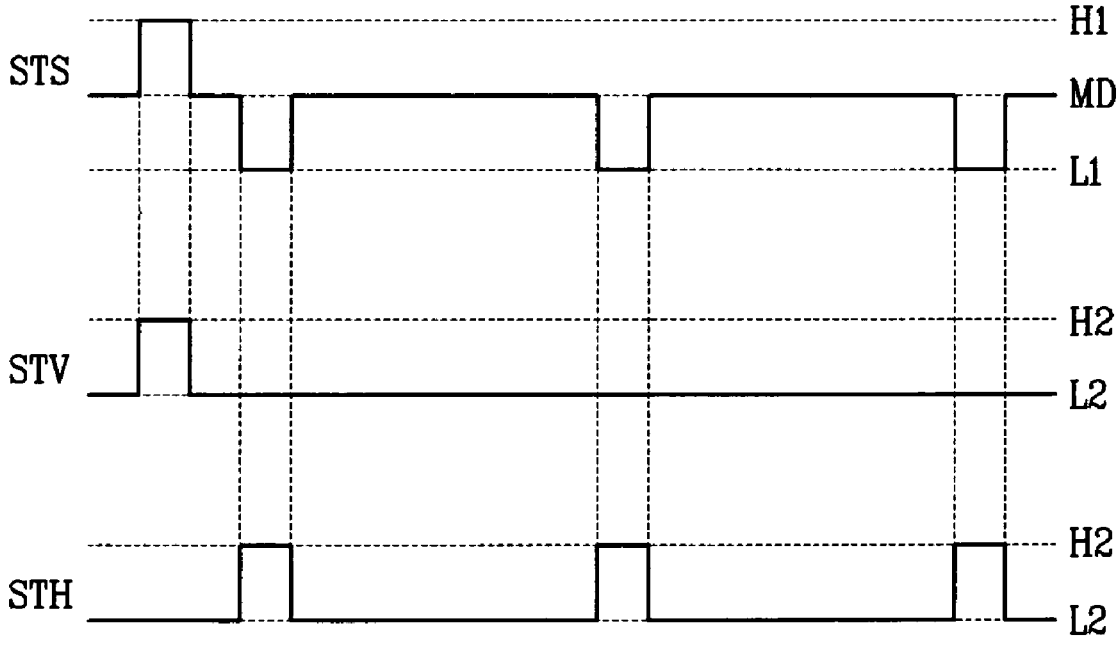
FIG. 4 shows waveforms of driving signals of a driving apparatus for an LCD according to an embodiment of the present invention.
Figure 5:
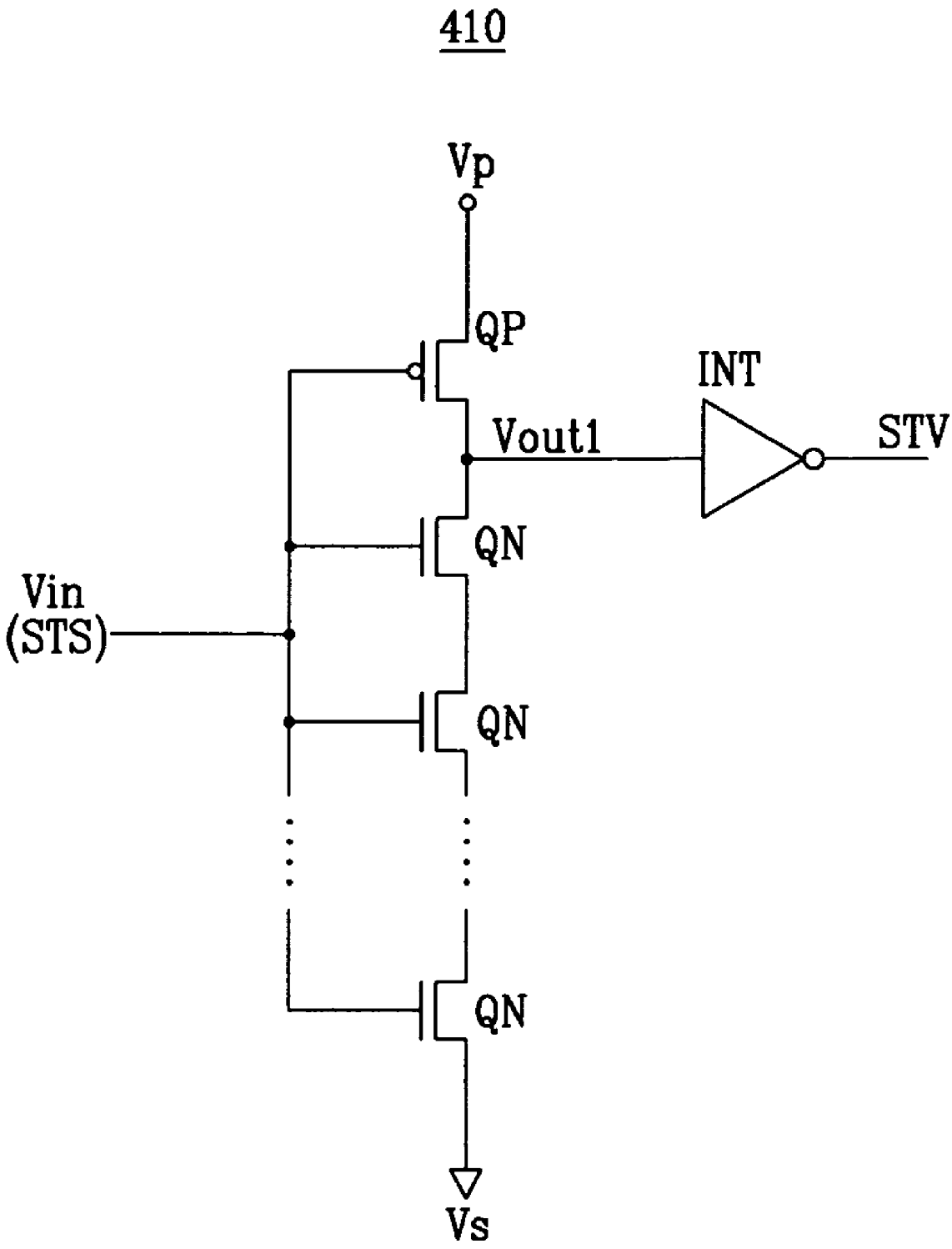
FIG. 5 is a circuit diagram of a first signal extractor according to an embodiment of the present invention.
Figure 6:
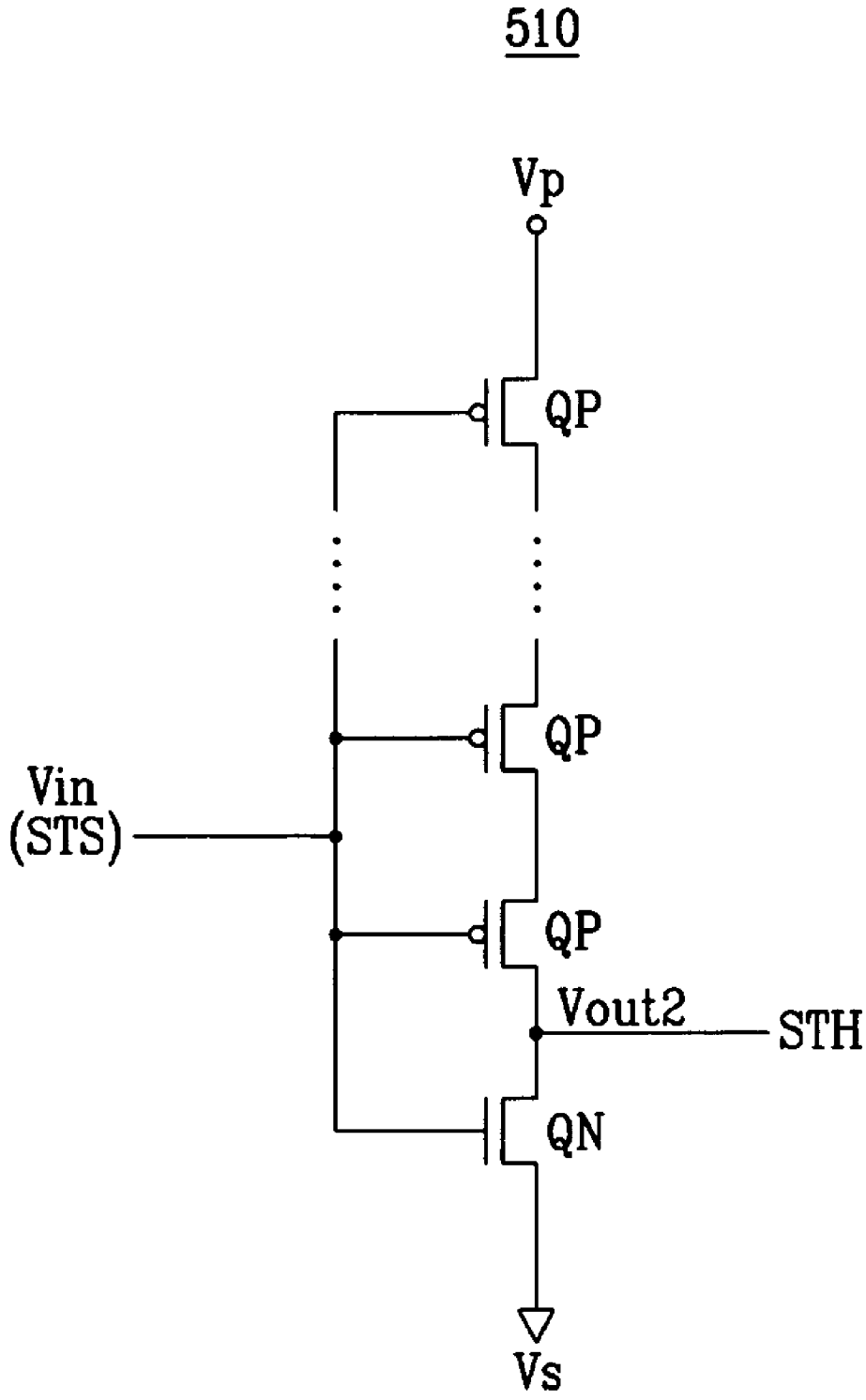
FIG. 6 is a circuit diagram of a second signal extractor according to an embodiment of the present invention.
Figure 7:
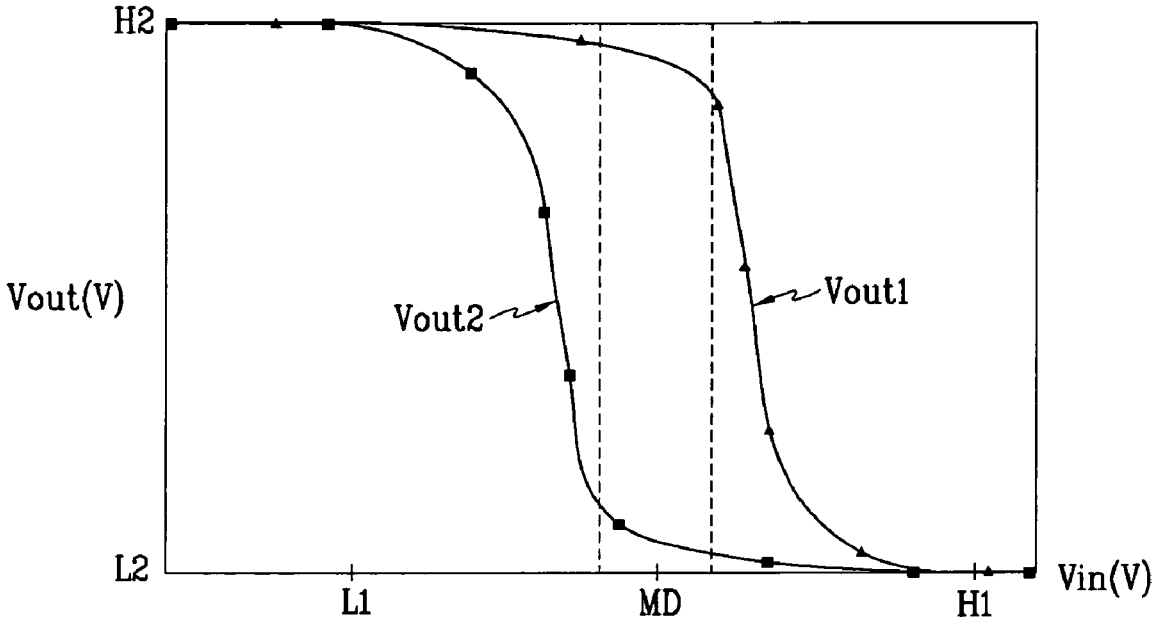
FIG. 7 shows waveforms indicating input-output characteristics of the circuits shown in FIGS. 5 and 6.

FIG. 3 is a block diagram of a driving apparatus for an LCD according to an embodiment of the present invention, FIG. 4 shows waveforms of driving signals of a driving apparatus for an LCD according to an embodiment of the present invention, FIG. 5 is a circuit diagram of a first signal extractor according an embodiment of the present invention, and FIG. 6 is a circuit diagram of a second signal extractor according an embodiment of the present invention. FIG. 7 shows waveforms indicating input-output characteristics of the circuits shown in FIGS. 5 and 6.

A driving apparatus for an LCD according to an embodiment of the present invention includes a single IC chip 610, first and second signal extractors 410 and 510, and a gate shift register 420 and a data shift register 520.

The single IC chip 610 is an IC chip executing some functions of the signal controller 600, the gray voltage generator 800, and the data driver 500. Therefore, the single IC chip 610 receives the input image signals R, G, and B and input control signals CONT from the external graphics controller (not shown) and processes the input image signals R, G, and B to be suitable for the operation of the LCD based on the input control signals CONT. Then, the single IC chip 610 converts the processed image signals DAT into data signals Vd and transmits them to the data shift register 520.

The single IC chip 610 may include a digital-analog converter (not shown) converting the digital image data DAT into analog data signals Vd.

The signal IC chip 610 generates a synthesis signal STS that is a synthesis of the scanning start signal STV and the horizontal synchronization start signal STH based on the input control signals CONT, and outputs it to the first and second signal extractors 410 and 510 through a signal line. Gate control signals CONT1' except the scanning start signal STV are input to the gate shift register 420, and data control signals CONT2' except the horizontal synchronization start signal STH are input to the data shift register 520.

The synthesis signal STS has three logic levels, HIGH, MIDDLE, and LOW. The scanning start signal STV and the horizontal synchronization start signal STH have two logic levels, HIGH and LOW. The relationships of the signals STS, STV, and STH are shown in the following Table 1.

TABLE 1

| STS | STV | STH |
|---|---|---|
| HIGH | HIGH | LOW |
| MIDDLE | LOW | LOW |
| LOW | LOW | HIGH |

As shown in FIG. 4, a high level, a middle level, and a low level of the synthesis signal STS have voltage levels corresponding to H1, MD, and L1, respectively. For example, voltage values of the high, middle, and low levels are about 3V, 0V, and −3V, respectively. Unlike the scanning start signal STV and the horizontal synchronization start signal STH, the high and low levels of the scanning start signal STV and the horizontal synchronization start signal STH have voltage levels corresponding to H2 and L2, respectively, and the high level is about 8.5V and the low level is about 0V.

The first signal extractor 410 receives the synthesis signal STS from the signal IC chip 610 and extracts the scanning start signal STV from the synthesis signal STS to transfer the scanning start signal STV to the gate shift register 410.

Referring to FIG. 5, the first signal extractor 410 includes a PMOS (p-channel metal-oxide semiconductor) transistor QP, a plurality of NMOS (n-channel metal-oxide semiconductor) transistors ON, and an inverter INT. The PMOS transistor OP and the NMOS transistors ON are switching elements having three terminals. The output terminals and the input terminals of the PMOS transistor OP and the NMOS transistors ON are sequentially connected in series to each other. The input terminal of the PMOS transistor OP is connected to a driving voltage Vp, and the output terminal of the last NMOS transistor ON is connected to a ground voltage Vs. The control terminals of the PMOS and NMOS transistors QP and ON are connected to each other and are supplied with the synthesis signal STS. The terminal between the output terminal of the PMOS transistor OP and the input terminal of the first NMOS transistor ON is connected to the inverter INT. A voltage Vout1 of the output terminal of the inverter INT functions as the scanning start signal STV.

Referring to FIG. 7, when the synthesis signal STS is the high level H1, the PMOS transistor QP is turned off and the NMOS transistors ON are turned on. Thereby, since the output voltage Vout1 has a high level, the scanning start signal STV has the low level L2. When the synthesis signal STS is the middle level MD, the output voltage Vout1 has a high level and thereby the scanning start signal STV has the low level L2. In FIG. 5, the PMOS transistor QP and the NMOS transistors ON operate like resistors and function as a voltage divider dividing the driving voltage Vp based on the number of the PMOS and NMOS transistors OP and ON.

The first signal extractor 410 may include a plurality of PMOS transistors, and the number of the PMOS and NMOS transistors QP and ON may be varied.

The second signal extractor 510 receives the synthesis signal STS from the signal IC chip 610 and extracts the horizontal synchronization start signal STH from the synthesis signal STS to transfer the horizontal synchronization start signal STH to the data shift resistor 520.

Referring to FIG. 6, the second signal extractor 510 includes a plurality of PMOS transistors QP and an NMOS transistor ON. As above described, the PMOS transistors QP and the NMOS transistor QN are switching elements having three terminals. The output terminals and the input terminals of the PMOS transistors QP and the NMOS transistor ON are sequentially connected in series to each other. The input terminal of the first PMOS transistor OP is connected to a driving voltage Vp, and the output terminal of the NMOS transistor ON is connected to a ground voltage Vs. The control terminals of the PMOS and NMOS transistors QP and ON are connected to each other and are supplied with the synthesis signal STS. The terminal between the output terminal of the last PMOS transistor QP and the input terminal of the NMOS transistor ON outputs an output voltage Vout2 as the horizontal synchronization start signal STH.

Referring to FIG. 7, when the synthesis signal STS is the high level H1, the PMOS transistors QP are turned off and the NMOS transistor ON is turned on, and thereby the output voltage Vout2 having a low level L2 is outputted as the horizontal synchronization start signal STH. When the synthesis signal STS is the low level L2, the PMOS transistors QP are turned on and the NMOS transistor ON is turned off, and thereby the horizontal synchronization start signal STH becomes the high level H2. When the synthesis signal STS is the middle level MD, the horizontal synchronization start signal STH becomes the high level H2. In FIG. 6, the PMOS transistors OP and the NMOS transistor ON operate like resistors and function as a voltage divider dividing the driving voltage Vp based on the number of PMOS and NMOS transistors QP and ON.

The second signal extractor 510 may include a plurality of NMOS transistors, and the number of the PMOS and NMOS transistors OP and ON may be varied.

The first and second signal extractors 410 and 510 and the gate and data shift registers 420 and 520 may be integrated with the LC panel assembly 300.

The gate shift register 420 generates gate signals Vg based on the scanning start signal STV and the gate control signals CONT1' from the first signal extractor 410 and the single IC chip 610, to sequentially scan the gate lines $G_1$ to $G_n$.

The data shift register 520 applies the data signals Vd to the data lines $D_1$ to $D_m$ based on the horizontal synchronization start signal STH, data signals Vd, and the data control signals CONT2' supplied from the second signal extractor 510 and the single IC chip 610.

As above-described, since the single IC chip 610 synthesizes two signals such as the scanning start signal STV and the horizontal synchronization start signal STH to make one signal STS, and outputs the synthesized signal STS through one signal line, the number of output terminals of the single IC chip 610 is reduced.

In the embodiment of the present invention, the single IC chip 610 synthesizes the scanning start signal STV and the horizontal synchronization start signal STH. However, the single IC chip 610 may synthesize other signals except the scanning start signal STV and the horizontal synchronization start signal STH to output through one signal line.

Furthermore, the single IC chip 610 may synthesize at least three signals to make one synthesized signal having at least four levels, and in this case, circuits extracting the respective at least three signals may include various combinations of PMOS transistors and NMOS transistors.

The present invention is described by using an LCD as an embodiment, but it may be adapted to various display devices such as plasma display devices (PDPs), organic light emitting displays (OLEDs), etc.

According to the present invention, since the IC chip synthesizes two signals to make one signal and outputs the synthesized signal through one signal line, the number of output terminals of the IC chip is reduced.

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. A driving apparatus for a display device, comprising:

a signal controller synthesizing first and second control signals, respectively, having first and second signal levels to output a synthesized signal having third to fifth signal levels;

a signal extracting unit extracting the first and second control signals from the synthesized signal;

a gate driver generating gate signals based on the first control signal; and a data driver generating data signals based on the second control signal, wherein the third to fifth signal levels are a high level, a middle level, and a low level, respectively, and when the synthesized signal is the middle level, the first and second control signals are signal levels that are equal to each other.

2. The driving apparatus of claim 1, wherein the synthesized signal is generated on the basis of combinations of the signal levels of the first and second control signals.

3. The driving apparatus of claim 1, wherein the first and second control signals have the same signal level as each other with respect to one signal level of the third to fifth signal levels.

4. The driving apparatus of claim 1, wherein when the first and second control signals have the first signal level, the synthesized signal has the third signal level, when the first control signal has the first signal level and the second control signal has the second signal level, the synthesized signal has the fourth signal level, when the first control signal has the second signal level and the second control signal has the first signal level, the synthesized signal has the fifth signal level, and the first and fourth signal levels are a low level, the second and fifth signal level are a high level, and the third signal level is a middle level.

5. The driving apparatus of claim 1, wherein the first and second control signals are each transferred to the gate and data drivers through different signal lines.

6. A driving apparatus for a display device, comprising:

a signal controller synthesizing first and second control signals, respectively, having first and second signal levels to output a synthesized signal having third to fifth signal levels;

a signal extracting unit extracting the first and second control signals from the synthesized signal;

a gate driver generating gate signals based on the first control signal; and a data driver generating data signals based on the second control signal, wherein the signal extracting unit comprises first and second signal extractors extracting the first and second control signals, respectively.

7. The driving apparatus of claim 6, wherein the first signal extractor comprises at least one PMOS transistor and a plurality of NMOS transistors, and a number of the NMOS transistors is greater than a number of the PMOS transistors.

8. The driving apparatus of claim 7, wherein the PMOS transistor and the NMOS transistors have output and input terminals connected in series to each other, and have control terminals connected to each other and that are supplied with the synthesized signal.

9. The driving apparatus of claim 6, wherein the second signal extractor comprises a plurality of PMOS transistors and at least one NMOS transistor, and wherein the number of the PMOS transistors is greater than that of the NMOS transistor.

10. The driving apparatus of claim 9, wherein the PMOS transistors and the NMOS transistors have output and input terminals connected in series to each other, and have control terminals connected to each other and supplied with the synthesized signal.

11. The driving apparatus of claim 9, wherein the first control signal is a scanning start signal and the second control signal is a horizontal synchronization start signal.

12. The driving apparatus of claim 6, wherein one of the first and second signal extractors comprises an inverter.

13. A display device, comprising:

a signal controller synthesizing first and second control signals, respectively, having first and second signal levels to output a synthesized signal having third to fifth signal levels;

a signal extracting unit extracting the first and second control signals from the synthesized signal;

a gate driver generating gate signals based on the first control signal; and a data driver generating data signals based on the second control signal, wherein the third to fifth signal levels are a high level, a middle level, and a low level, respectively, and when the synthesized signal is the middle level, the first and second control signals are signal levels that are equal to each other.

14. The display device of claim 13, wherein the first control signal is a scanning start signal and the second control signal is a horizontal synchronization start signal.

15. A driving method of a display device, comprising:

synthesizing first and second control signals of two signal levels to output a synthesized signal having three signal levels;

extracting the first and second control signals from the synthesized signal;

outputting gate signals based on the extracted first control signal; and outputting data signals based on the extracted second control signal, wherein the three signal levels are a high level, a middle level, and a low level, respectively, and when the synthesized signal is the middle level, the first and second control signals are signal levels that are equal to each other.

* * * * *